US005400020A

United States Patent [19]

Jones et al.

[11] Patent Number: 5,400,020

[45] Date of Patent: Mar. 21, 1995

[54] ADVANCE NOTIFICATION SYSTEM AND METHOD

[75] Inventors: Martin K. Jones, Dalton; Eugenia B. Payne; Mark W. Stubbins, both of Rome, all of Ga.

[73] Assignee: Global Research Systems, Inc., Rome, Ga.

[21] Appl. No.: 63,533

[22] Filed: May 18, 1993

[51] Int. Cl.[6] ..... G08G 1/123

[52] U.S. Cl. ..... 340/994; 340/992; 379/58

[58] Field of Search ..... 340/988, 989, 992, 994; 364/436; 379/58, 59; 455/53.1, 54.1

[56] References Cited

U.S. PATENT DOCUMENTS

| | | | |
|---|---|---|---|
| 4,325,057 | 4/1982 | Bishop | 340/539 |
| 4,350,969 | 9/1982 | Greer | 340/994 |
| 4,713,661 | 12/1987 | Boone et al. | 340/994 |
| 4,799,162 | 1/1989 | Shinkawa et al. | 340/994 |
| 5,021,780 | 6/1991 | Fabiano et al. | 340/994 |
| 5,144,301 | 9/1992 | Jackson et al. | 340/994 |
| 5,218,629 | 6/1993 | Dumond, Jr. et al. | 379/58 |

FOREIGN PATENT DOCUMENTS

| | | | |
|---|---|---|---|
| 2559930 | 8/1985 | France | 340/994 |
| 2674355 | 9/1992 | France | 340/994 |
| 0066175 | 6/1977 | Japan | 340/994 |
| 0288400 | 11/1988 | Japan | 340/994 |

*Primary Examiner*—Brent Swarthout
*Attorney, Agent, or Firm*—Hopkins & Thomas

[57] ABSTRACT

An advance notification system (10) and method for notifying school children of the impending arrival of their school bus (19). The system includes an on-board vehicle control unit (12) for each bus (19) and a base station control unit (14) for making telephone calls to the homes (29) of school children in order to inform them that the bus (19) is a certain time period away from a bus stop. The vehicle control unit (12) compares elapsed time to the programmed scheduled time for each bus stop to determine if the bus (19) is on schedule. If the bus (19) is behind or ahead of schedule, the vehicle control unit (12) calls the base station control unit (14), which then resets its calling schedule accordingly.

24 Claims, 6 Drawing Sheets

ADVANCE NOTIFICATION SYSTEM AND METHOD

FIELD OF THE INVENTION

The present invention pertains to notification systems for notifying persons of the impending arrival of a particular transportation vehicle, such as a bus, train, plane, fishing vessel, or other vessel.

BACKGROUND OF THE INVENTION

There are many situations in which it is desirable for passengers to know of the approximate arrival time of a particular transportation vehicle shortly before the vehicle is to arrive at a particular destination. With such information, passengers can adjust their schedules accordingly and avoid having to wait on the particular vehicle to reach the particular destination. For example, a person having to pick up a friend or relative at a commercial bus station either has to call the bus station to find out the approximate arrival time, which information is oftentimes unavailable, or plan on arriving at the bus station prior to the scheduled arrival time of the bus and hope the bus is not delayed.

Another example is in the commercial fishing industry, wherein fish markets, restaurants, and other establishments desire to purchase fish immediately upon arrival of a commercial fishing boat at a port. Currently, such establishments, in order to ensure being able to purchase the freshest catch, often depend on predetermined schedules of fishing fleets, which are not always accurate or reliable.

Still another example involves school children who ride school buses. School children who ride buses to school often have to wait at their bus stops for extended lengths of time because school buses arrive at a particular bus stop at substantially different times from one day to the next. The reason is that school buses are not always the best maintained vehicles on the roads, frequently must operate during rush hour traffic, and must contend with congested urban/suburban conditions. As a result, school children are forced to wait at their bus stops for long periods of time, oftentimes in adverse weather conditions, on unlit street corners, or in hazardous conditions near busy or secluded streets. If it is raining, snowing, windy and cold, or even dark, such conditions can be unhealthy and unsafe for children.

Thus, generally, it would be desirable for a passenger to know when a vessel, such as a bus, train, plane, or the like, is a particular time period (number of minutes or seconds) from arriving at a destination so that the passenger can adjust his/her schedule and avoid arriving too early or late.

In the past, in order to combat the arrival time problem in the context of school buses, student notification systems have been employed that use a transmitter on each bus and a receiver inside each student home. When the school bus and its on-board transmitter come within range of a particular home receiver, the transmitter sends a signal to the receiver, which in turn produces an indicator signal to notify the student that his/her school bus is nearby. While such notification systems work satisfactorily under certain circumstances, nevertheless, these systems are limited by the range of the transmitters and require the purchase of relatively expensive receivers for each student. In addition, such systems provide little flexibility for providing additional information to the students, such as notifying them of the delayed arrival of a bus, alternative bus route information, or information regarding important school events.

Accordingly, a heretofore unaddressed need exists in the art for an inexpensive, advance notification system that is suitable for many applications requiring advanced notification of the impending arrival of a transportation vehicle, but which is particularly suitable for school bus systems, is capable of notifying students of the impending arrival of their bus in a reliable, efficient manner, and is flexible enough to provide additional information to the students.

SUMMARY OF THE INVENTION

Briefly described, the present invention is an advance notification system for notifying passengers of an impending arrival of a vehicle as the vehicle progresses along a scheduled route with particular stop locations and corresponding scheduled times of arrival at the stop locations. The advance notification system generally comprises a vehicle control unit disposed on each vehicle and a base station control unit which is configured to communicate with all of the vehicle control units.

The vehicle control unit includes a vehicle control means, a vehicle communication means controlled by the vehicle control means, an input means for signalling to the vehicle control means when the vehicle reaches particular positions along the scheduled route, and a vehicle clock for tracking elapsed time of the vehicle while on the scheduled route. The control means is adapted to initiate calls on the vehicle communication means when the elapsed time of the vehicle at any of the particular positions is ahead of the scheduled time and when the elapsed time of the vehicle at any of the particular locations is behind the scheduled time. In the preferred embodiment, the vehicle communication means is a wireless communication interface, such as a mobile telephone, RF transceiver, or other similar device.

The base station control unit has a base station communication means and a base station control means for controlling the base station communication means. The base station communication means receives the calls from the vehicle control unit and receives the amount of time in which the vehicle is ahead in time or behind in time. When the vehicle is to be early or late, the control means calls each of the passengers to be boarded at a particular stop location via the base station communication means prior to the arrival of the vehicle at the particular stop location. In the preferred embodiment, the base station communication means comprises a wireless communication interface, such as a mobile telephone or RF transceiver (both transmitter and receiver), for communicating with the vehicle communication means and also comprises at least one telephone for calling students.

It should be emphasized that while the present invention is particularly suited for application to school buses, there are many other applications wherein the features of the present invention can be employed to achieve the advantages of advance notification. As examples, the present invention could be employed with commercial buses, trains, planes, fishing vessels, or numerous other transportation vehicles.

Other objects, features, and advantages of the present invention will become apparent from the following specification, when read in conjunction with the accompanying drawings.

BRIEF DESCRIPTION OF THE DRAWINGS

The present invention can be better understood with reference to the following drawings. The drawings are not necessarily to scale, emphasis instead being placed upon clearly illustrating principles of the present invention.

DETAILED DESCRIPTION OF THE PREFERRED EMBODIMENT

The features and principles of the present invention will now be described relative to a preferred embodiment thereof. It will be apparent to those skilled in the art that numerous variations or modifications may be made to the preferred embodiment without departing from the spirit and scope of the present invention. Thus, such variations and modifications are intended to be included herein within the scope of the present invention.

I. System Architecture

Figure 1:
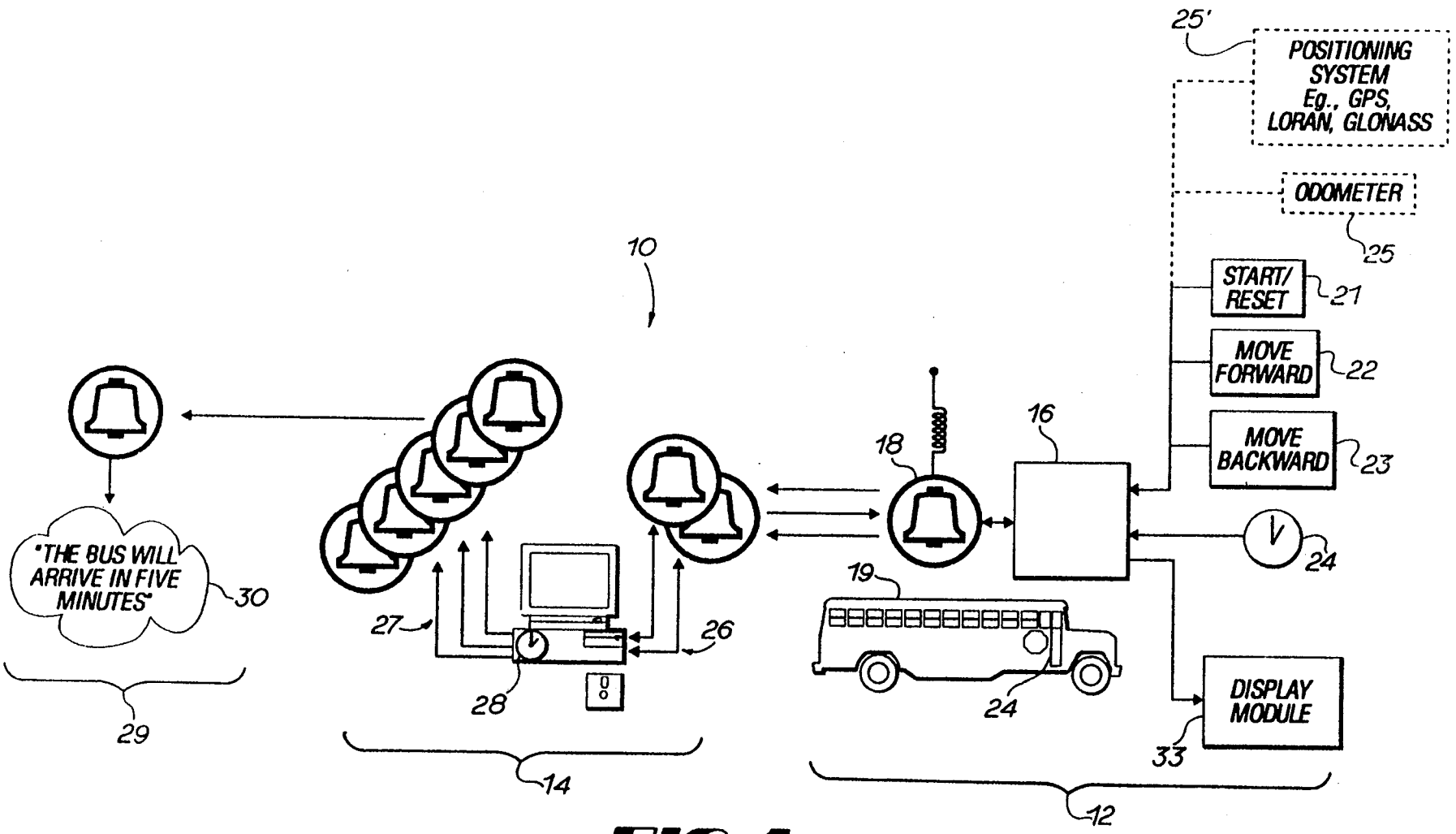
FIG. 1 is a high level schematic diagram of a preferred embodiment of the advance notification system of the present invention as applied in a school bus system.

Referring now in more detail to the drawings, in which like reference numerals represent corresponding parts throughout the several views, FIG. 1 is a schematic diagram of the advance notification system 10 of the present invention as configured to operate in, for example but not limited to, a school bus system. The advance notification system 10 comprises, preferably, a plurality of on-board vehicle control units 12 and a single base station control unit 14. As configured in the school bus system, a vehicle computer unit 12 is installed in each of a plurality of school buses 19, all of which communicate with the single base station control unit 14.

Each vehicle control unit 12 comprises a microprocessor controller 16, preferably an MC68HC705C8P microprocessor manufactured and commercially available from the Motorola Corporation, U.S.A. The microprocessor controller 16 is interfaced with a communication means 18, preferably a wireless communication device, for intercommunication with the base station computer unit 14. In the preferred embodiment, a mobile/cellular telephone is utilized as the communication means 18, but other devices for this purpose are possible, for example, a transceiver (having both a transmitter and receiver) operating at perhaps RF frequencies.

The microprocessor controller 16 is also interfaced with a start/reset switch 21 to be actuated by the bus driver upon starting along the bus's scheduled route, a move forward switch 22 to be actuated by the bus driver upon reaching a bus stop in order to inform the vehicle control unit 12 of this occurrence, as will be further described in detail hereinafter, a move backward switch 23 to be actuated by the bus driver at a bus stop if the bus driver has erroneously toggled the move forward switch 22 too many times, as will be further described in detail hereinafter, a real time clock 24 for tracking the elapsed time as the bus travels along its scheduled route, and a display module 33 for informing the bus driver as to the number corresponding to the next stop and the time (preferably, in seconds) necessary to reach the next stop. Other types of information may also be displayed on the display module 33. For example, the display module 33 may display the amount of time that the bus 19 is ahead of or behind schedule, the status of the vehicle control unit 12 in communication with the base station control unit 14, or, upon actuation of start button 21, that the advance notification system 10 is operating. Moreover, the move forward switch 22 and the move backward switch 23 cause the next stop designation which is displayed on the display module 33 and stored in the vehicle control unit 12 to toggle forward and backward, respectively. It should be further noted that the move forward switch 22 may be implemented by situating a sensing device (not shown) for detecting the opening and/or closing of the front door 24 of the school bus 19.

The base station computer 14 is any conventional personal computer with, optionally, a set of voice processing cards, which are well known in the art, for communicating with the plurality of homes of the students, as depicted by a reference numeral 29. The system 10 could be configured to merely call prospective passengers, thus warning them of the impending arrival of a bus 19, as opposed to forwarding both a call and a message. In the preferred embodiment, the base station control unit 14 includes at least one telephone line 26 dedicated for communication with the vehicle control units 12. However, as mentioned previously, the base station control unit 14 may be designed to communicate with the vehicle control units 12 via any transceiver, in which case, the base station control unit 14 would comprise a corresponding transceiver having the ability to receive a plurality of signals from the plurality of buses 19.

The base station control unit 14 also includes at least one, but preferably a plurality of, telephone lines 27 for making the telephone calls to the homes 29 of the school children. The student calling program (FIG. 7) for the advance notification system 10 is designed to make the telephone calls to the homes 29 of the students and allow the telephone to ring twice so that it is not necessary for the telephone to be answered in order for the telephone call to be recognized as that of the advance notification system 10. However, in the case where a parent or a student answers the telephone, a prerecorded message may be played by the base station control unit 14. An example of a message would be: "The bus will arrive in five minutes," as indicated in FIG. 1 at the reference numeral 30.

Figure 2:
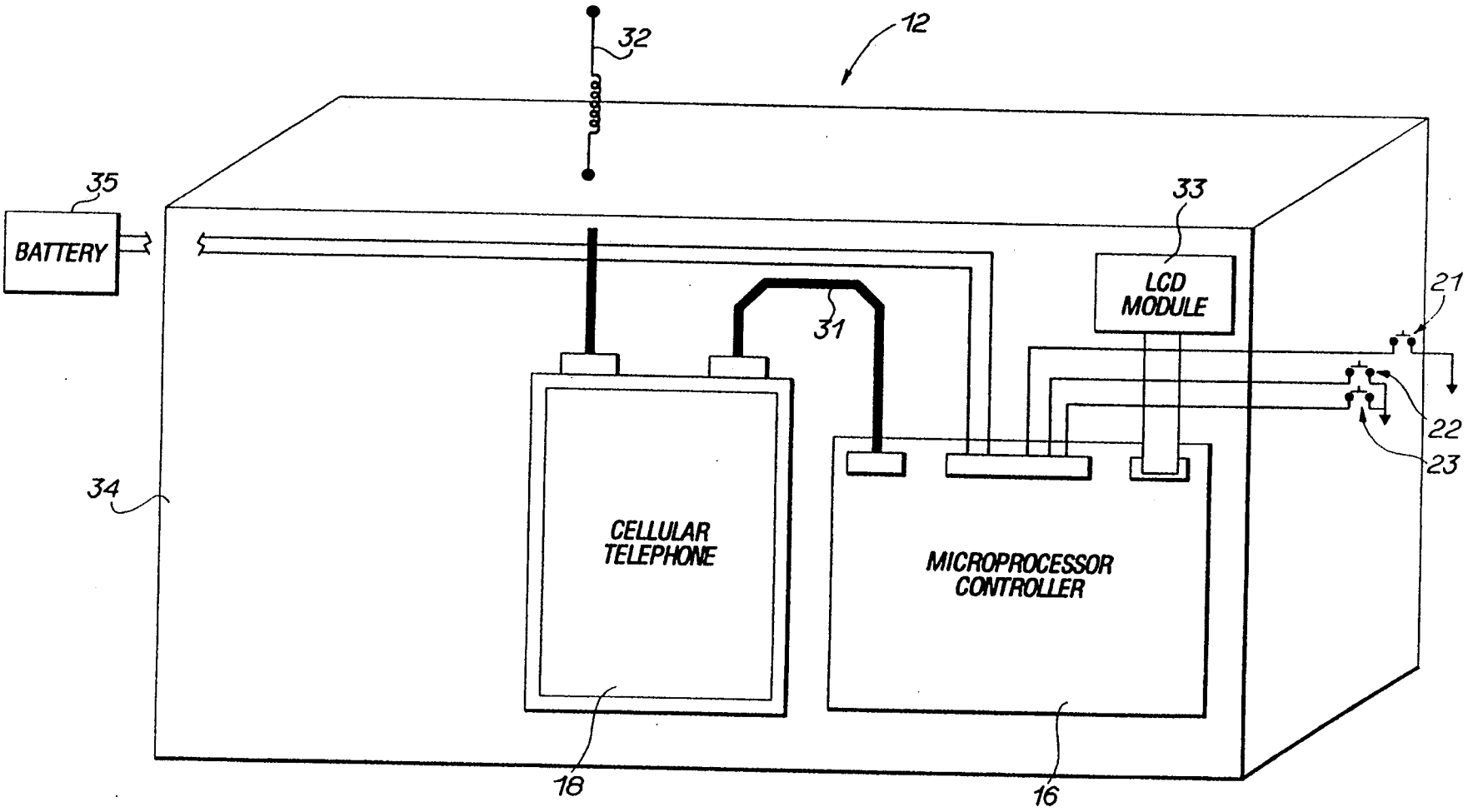
FIG. 2 is a high level schematic diagram of the vehicle control unit of the advance notification system of FIG. 1.

FIG. 2 is a schematic diagram of the vehicle control unit 12. The vehicle control unit 12 is designed to be a compact unit with a generally rectangular housing 34 that is mounted preferably on or in front of the dashboard of the bus 19 in view and within reach of the bus driver. In the housing 34, the microprocessor controller 16 is interfaced with the mobile telephone 18 by a telephone jack 31, preferably a conventional 8-conductor jack, and the mobile telephone 18 includes an antenna 32 for transmitting and receiving signals to and from the base station control unit 14. Further, the vehicle control unit 12 includes a liquid crystal display (LCD) module 33 disposed for external viewing of the display by the bus driver for providing information to the bus driver, as described previously.

Figure 3:
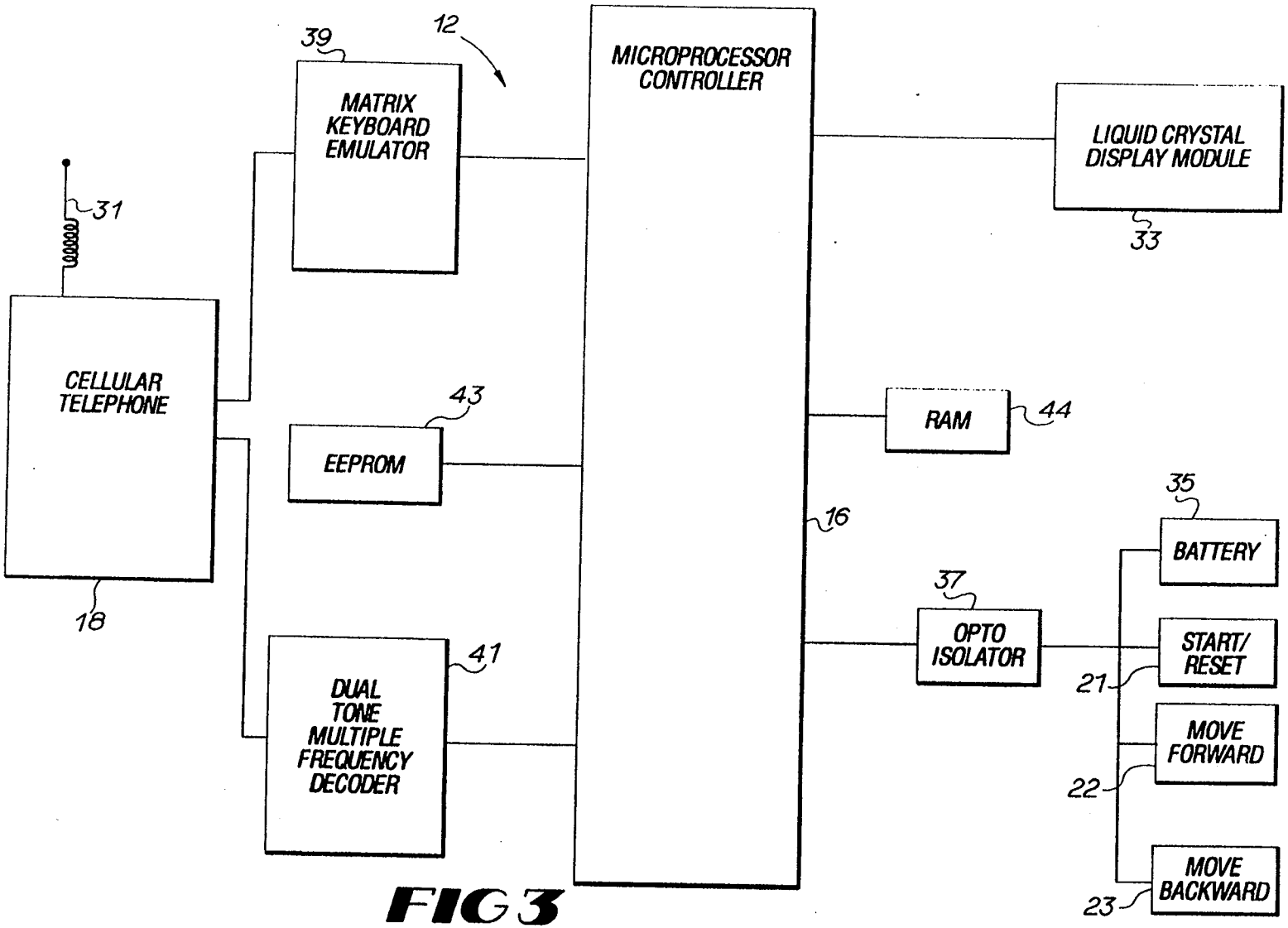
FIG. 3 is a low level block diagram of the vehicle control unit of FIGS. 1 and 2.

FIG. 3 is a block diagram of the electronic components associated with the vehicle control unit 12. The microprocessor controller 16 essentially controls the operation of the mobile telephone 18 and the LCD display module 33. A switching element 37, such as an opto-isolator unit 37, provides a buffer between the microprocessor controller 16 and the battery 35 as well as switches 21, 22, 23. An EEPROM 43 is provided for storing the control programs (FIGS. 6 and 7) and other requisite data for the microprocessor controller 16, and a RAM 44 is provided for running the control programs in the microprocessor controller 16. A matrix keyboard emulator 39 is interfaced between the mobile telephone 18 and the microprocessor controller 16 for allowing the microprocessor controller to control the operation of the mobile telephone 18. A dual tone multiple frequency decoder 41 is interfaced between the mobile telephone 18 and the microprocessor controller 16 for decoding modem signals or tones received by the mobile telephone 18 from the base station control unit 14.

II. System Operation

Initially, the bus schedule for each bus 19 is programmed into the advance notification system 10 by having the respective bus driver drive his respective bus one time along the corresponding scheduled bus route at the approximate speed the bus would usually travel on the route and with the bus driver making all the scheduled stops along the route and waiting at each stop for the approximate time it would take for all the students at that stop to board the bus 19. As the bus driver drives the bus 19 along the route for initialization purposes, the internal real time clock 24 runs and the bus driver actuates the switches 21, 22, 23 as required in accordance with the principles described previously. The timing information is recorded in the memory (RAM 44 and EEPROM 43) of the vehicle control unit 12.

The timing information which is recorded during the initialization of the system 10 is used as a reference during the usual operation of the system 10 for the purpose of determining whether a bus 19 is early or late at each of the bus stops. In the preferred embodiment, determining the status of a bus 19 is accomplished by comparing the time at which a bus 19 actually departs from a stop to the scheduled time of departure.

However, it should be emphasized that other methodologies could be utilized for determining whether the bus 19 is early or late. For example, the odometer 25 of the bus 19, as indicated by phantom lines, could be monitored by the microprocessor controller 16. At particular times, the odometer mileage reading could be compared to reference odometer mileage readings which were obtained during the initialization of the system 10. In this way, the determination of whether a bus 19 is early or late can occur at any time during a bus route and can occur as many times as desired.

Another methodology which could be utilized for determining whether the bus 19 is early or late involves interfacing the vehicle control unit 12 with a positioning system 25', as shown in FIG. 1 by phantom lines. The positioning system 25' could be the GPS (global positioning system), the LORAN positioning system, the GLONASS positioning system (USSR version of GPS), or some other similar position tracking system. From the data received from these positioning systems, the microprocessor controller 16 could determine where the bus 19 is situated on the earth at any given time. The bus location at a particular time could then be compared with scheduled locations and scheduled times in order to determine whether the bus 19 is early or late and by what amount.

Figure 4:
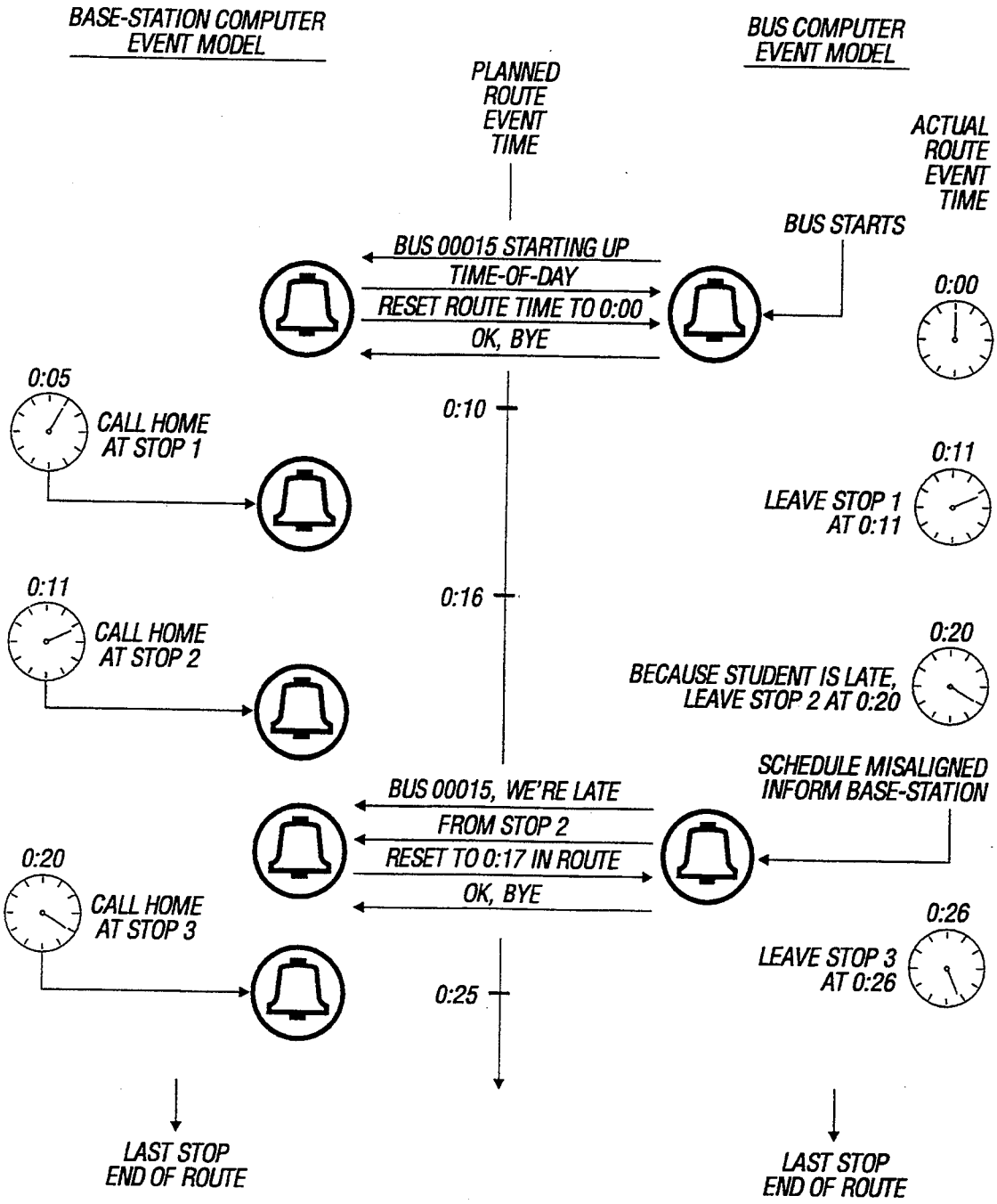
FIG. 4 is an example of a schedule for a sequence of events illustrating the operation of the advance notification system of FIG. 1.

As an example of the operation of the advance notification system 10 in accordance with the preferred embodiment, FIG. 4 shows an example of a schedule of possible events and the interactions which might occur between the vehicle control unit 12 and the base station control unit 14 as the bus 19 travels along its scheduled route and makes its scheduled stops. In the left hand column are illustrated the sequence of events for the base station computer 14, and in the right hand column are illustrated the sequence of events on the vehicle control unit 12. Between the right and left hand columns is illustrated a time line for the scheduled bus stops. The time line has the following time designations: ten minutes, sixteen minutes, and twenty-two minutes, all along the scheduled bus route.

At the beginning of the bus route, the bus driver presses the start/reset switch 21 on the vehicle control unit 12, which causes the microprocessor controller 16 to telephone the base station control unit 12 to inform the base station computer 12 of this fact and to initialize the advance notification system 10. Upon actuating the start/reset switch 21, the display module 33 preferably displays "Stop Number 1" followed by the amount of time to reach stop number 1. The time continuously runs as the bus 19 progresses along the bus route. In the example of FIG. 4, at five minutes along the scheduled route, the base station control unit 14 places a telephone call to the homes 29 of the school children to be picked up at bus stop number 1. At ten minutes along the schedule, the bus 19 arrives at the bus stop number 1 and takes one minute to load all the students at this stop onto the bus 19. Just prior to leaving stop 1, the bus driver actuates the move forward switch 22. Upon actuating the move forward switch 22, the display module 33 preferably displays "Stop Number 2" followed by the amount of time to reach stop number 2. As mentioned previously, the foregoing feedback signal may be generated by a sensing device coupled to the front door of the bus 19. The microprocessor controller 16 checks the elapsed time of eleven minutes to confirm that such time corresponds to the programmed time for bus stop number 1. It will determine whether the bus 19 is early or late. If the bus 19 is either early or late, the vehicle control unit 12 will call the base station control unit 14 to inform the unit 14 of this fact. In this example, it is assumed that the bus 19 is neither early nor late in leaving bus stop number 1.

Because the bus 19 is scheduled to arrive at bus stop number 2 at sixteen minutes along the route, at eleven minutes along the route the base station control unit 14 places telephone calls to the homes 29 of the school children who board the bus 19 at bus stop number 2. The bus 19 then arrives at bus stop number 2 and commences the boarding of students. However, because one of the school children is running late that particular morning, the bus 19 spends three minutes at bus stop number 2, and, thus, gets three minutes behind schedule.

Just prior to leaving bus stop number 2, the bus driver actuates the move forward switch 22, i.e., at twenty minutes along the route.

Upon receiving this information, the microprocessor controller 16 compares the departure time to the scheduled departure time of seventeen minutes and determines that the bus 19 is three minutes behind schedule. The microprocessor controller 16 then telephones the base station control unit 14 to inform the base station control unit 14 that the bus 19 is three minutes behind schedule. The base station control unit 14 then reschedules the telephone calls that are to be made to the parents of the students at bus stop number 3 from twenty-two minutes along the route to twenty-five minutes along the route and resets the vehicle control unit 12 to seventeen minutes along the route, the scheduled time for the bus to leave bus stop number 2. At twenty minutes along the route, the base station control unit 14 calls the homes 29 of the students of bus stop number 3 to inform them that the bus 19 is five minutes from arriving. At twenty-five minutes along the route, the bus 19 arrives at bus stop 3, takes one minute to load the students on to the bus 19 and then proceeds onto the school.

The system 10 may be configured so that if a bus 19 becomes delayed by more than a maximum length of time, such as fifteen minutes, the base station control unit 14 immediately calls the homes 29 of the remaining students to board the bus 19 in order to notify these homes 29 of the unusual delay and to notify these homes 29 to wait for a notification call.

III. Control Processes

Figure 5:
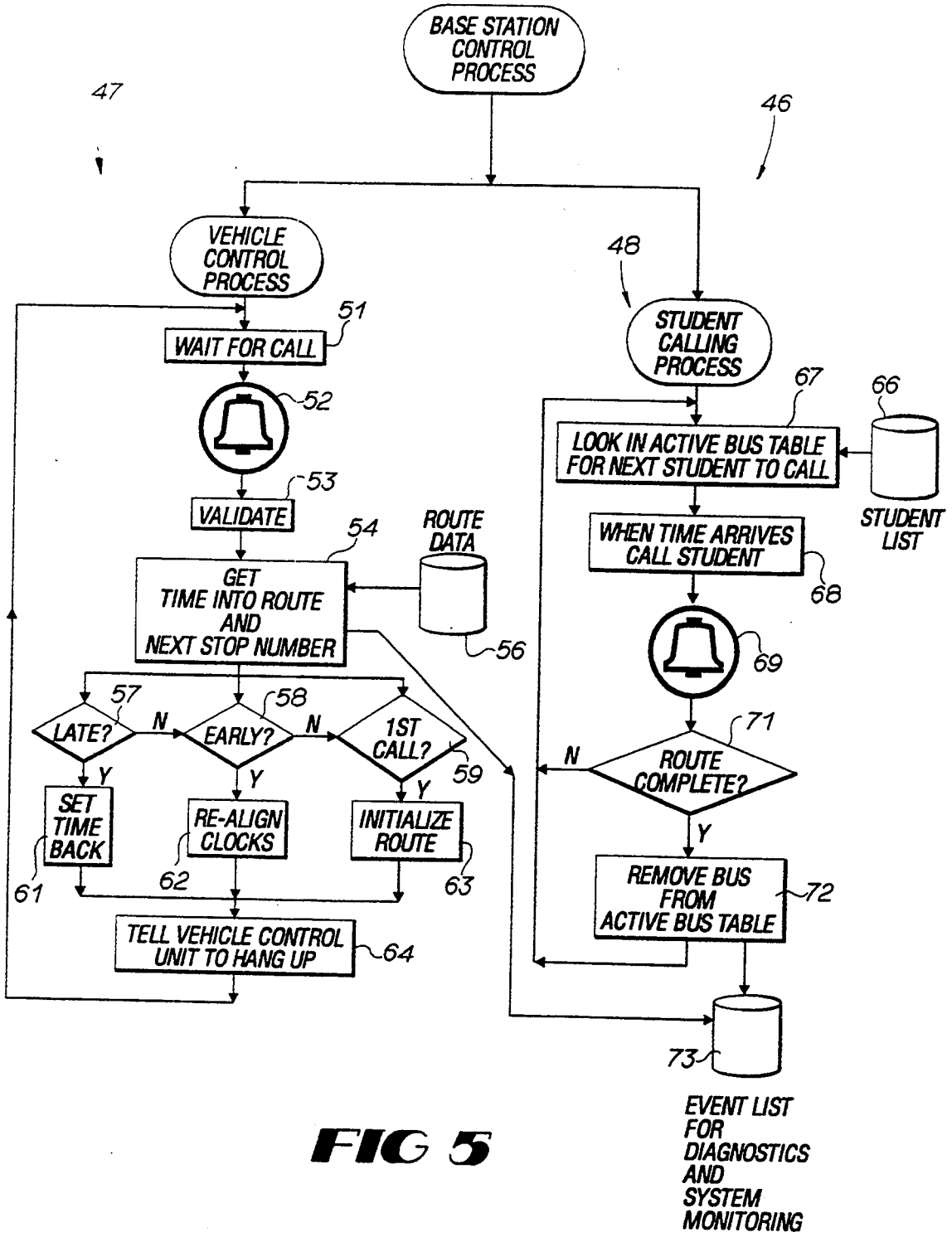
FIG. 5 is a flow chart of a base station control process for the base station control unit 14 of FIG. 1.
Figures 6, 7:
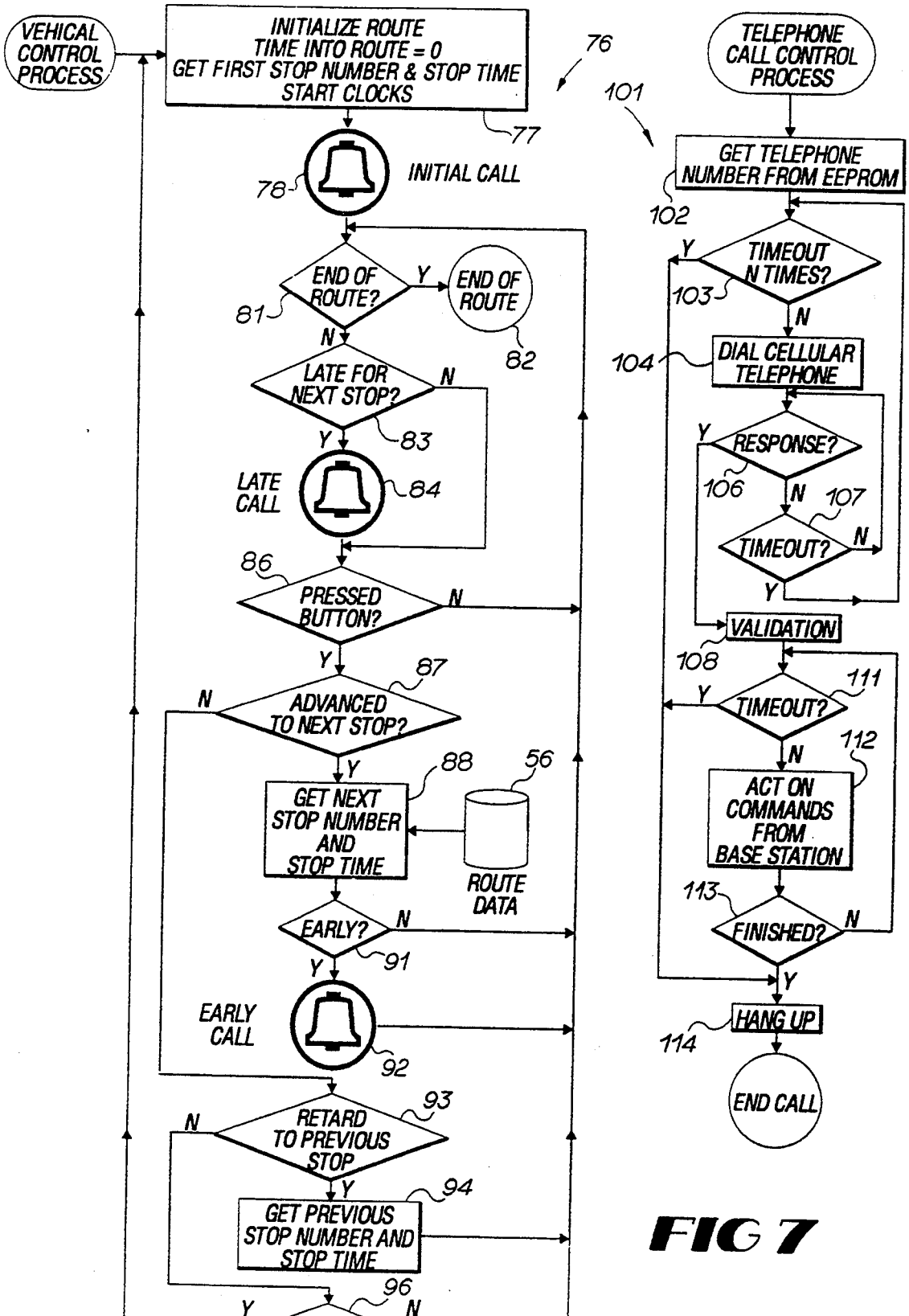
FIG. 6 is a flow chart of a vehicle control process for the vehicle control unit of FIGS. 1 and 2.
FIG. 7 is a flow chart of a telephone call control process for the vehicle control unit of FIGS. 1 and 2.

FIGS. 5 through 7 show flow charts pertaining to control processes or algorithms performed in the advance notification system 10 of FIG. 1 in order to achieve the functionality as set forth in FIG. 4 as described hereinbefore. These flow charts illustrate the best mode for practicing the invention at the time of filing this document. More specifically, FIG. 5 illustrates a base station control process 46 employed in the base station control unit 14, and FIGS. 6 and 7 show respectively a vehicle control process 76 and a telephone call control process 101 implemented in the vehicle control unit 12. The foregoing control processes are merely examples of plausible control algorithms, and an infinite number of control algorithms may be employed to practice the present invention. Furthermore, it should be noted that the base station control process of FIG. 5 is implemented via software within any conventional computer system, and the vehicle control process of FIG. 6 and the telephone call control process 101 of FIG. 7 are both implemented via software stored within memory and are run by the microprocessor controller 16. However, these control operations need not be implemented in software and could be implemented perhaps in hardware or even manually by human interaction.

A. Base Station Control Process

With reference to FIG. 5, the base station control process 46 essentially comprises two control subprocesses which run concurrently, namely, (1) a vehicle communications process 47 and (2) a student calling process 48. The vehicle communications process 47 will be described immediately hereafter followed by the student calling process 48.

1. Vehicle Communications Process

The vehicle communications process 47 initially waits for a telephone call from one of the vehicle control units 12 located on one of the plurality of buses 19, as indicated by a flow chart block 51. The vehicle communications process 47 is preferably capable of monitoring a plurality of telephone lines 26 for receiving information from a plurality of buses 19. As the number of buses 19 is increased, by necessity, the number of telephone lines 26 which are monitored by the vehicle communications process 47 must also be increased to an extent.

After a bus driver has triggered the start/reset switch 21 on his respective bus 19, the respective vehicle control unit 12 will initiate a telephone call to the base station computer 14, as indicated by the telephone bell symbol 52. The start/reset switch 21 is actuated by the bus driver at the beginning of a route. After the base station computer 14 receives the telephone call, a string of symbols is exchanged between the vehicle control unit 12 and the base station control unit 14 so as to validate the communication connection, as indicated in a flow chart block 53. In other words, the base station computer 14 ensures that it is in fact communicating with the vehicle control unit 12, and vice versa.

Next, as shown in a flow chart block 54, the base station computer 14 asks the vehicle control unit 12 for information regarding (1) the time into the route and (2) the number designating the next stop. In addition, route data 56 is obtained from a local data base. The route data 56 includes information pertaining to each bus stop and how much time it should take to reach each bus stop during the route. From the route data 56 and the information (1) and (2) received from the vehicle control unit 12, the base station computer 14 can determine whether the bus 19 is late or early, as indicated by flow chart blocks 57, 58, or whether the bus 19 has just started its route, as indicated by a flow chart block 59. In the case where the bus 19 is late, the base station computer 14 advises the vehicle control unit 12 to reset its on-board clock 24 back so that it thinks it is on time, as indicated in a flow chart block 61. In the case where the bus 19 is early, the bus base station computer 14 advises the vehicle control unit 12 to move its on-board clock 24 forward so that the vehicle control unit 12 thinks it is on time. Moreover, in the situation where the bus 19 has just started its route and the telephone call is essentially the first call of the route, the base station clock 28 and the on-board vehicle clock 24 are synchronized, as indicated in a flow chart block 63.

Finally, as shown in a flow chart block 64, the base station computer 14 informs the vehicle control unit 12 to terminate the telephone call, which was initiated in the flow chart block 51. The vehicle communications process 47 then proceeds once again to the flow chart block 51, where it will remain until receiving another telephone call from the bus 19.

Worth noting from the foregoing discussion is the fact that the base station control unit 14 is the ultimate controller of the advance notification system 10 from a hierarchical vantage point. The base station clock 28 maintains the absolute time of the advance notification system 10, while the vehicle clock 24 assumes a subservient role and is periodically reset when the bus 19 is at the start of a route or when the bus 19 is either early or late during the route. Further, it should be noted that the vehicle control unit 12 communicates to the base station control unit 14 only when the bus 19 is at the start of a route or when the bus 19 is either early or late during the route, so as to minimize the amount of time on the mobile telephone network and associated costs thereof.

2. Student Calling Process

As previously mentioned, the student calling process 48 runs concurrently with the vehicle communications process 47 within the base station control unit 14. In essence, the student calling process 48 uses the timing information retrieved from the bus 19 by the vehicle communications process 47 in order to call students and inform them of the approaching bus 19. A student list 66 is locally accessible from a local data base by the base station control unit 14 and comprises information regarding (1) student names, (2) student telephone numbers, and (3) the time into a bus route when a student should be called via telephone. In accordance with the student calling process 48, as indicated in a flow chart block 67, the student list 66 is consulted as time progresses and telephone numbers are retrieved. When a particular time for calling a particular student is reached, the student calling process 48 initiates a telephone call to the particular student, as shown in flow chart blocks 68, 69. The particular time is fully selectable by programming.

Also worth noting is that the process can also include a feature for monitoring calls to be placed in the future. In accordance with this feature, upon anticipation of a heavy load of calls, some of the calls would be initiated earlier than the originally scheduled, corresponding call time.

After the bus route has been completed by the bus 19, the particular bus and bus route are removed from consideration, as indicated by flow chart blocks 71, 72. Otherwise, the student calling process 48 returns to the student list 66 and searches for the next student to be called.

As further shown in FIG. 5, an event list 73 is maintained for diagnostics and system monitoring. The event list 73 receives data from both the vehicle communications process 47 and the student calling process 46. The event list 73 essentially comprises records of, among other things, all telephone calls and of all past and current bus locations.

B. Vehicle Control Process

Reference will now be made to the vehicle control process 76 shown in FIG. 6. Initially, as indicated in the flow chart block 77 of the vehicle control process 76, the vehicle control unit 12 runs through an initiation procedure in which the first stop number is retrieved, the stop time (time necessary to travel to the next stop) is retrieved, and the time into the route as indicated by the clock 24 is set at zero and the clock 24 is started. After the foregoing initialization procedure, a telephone call is initiated via the mobile telephone 18 to the base station control unit 14, as indicated by the telephone bell symbol 78. After the telephone connection, the vehicle control unit 12 and the base station control unit 14 exchange information as described hereinbefore and which will be further described hereinafter relative to FIG. 7.

Next, as shown in FIG. 6, the vehicle control process 76 begins a looping operation wherein the vehicle control unit 12 continuously monitors the start/reset switch 21, the move forward switch 23, and the move backward switch 24 and also continuously determines whether the bus 19 is early or late. As mentioned previously, the vehicle control process 76 initiates a telephone call only at start-up of a route, or when the bus 19 is either early or late.

While in the main looping operation, a determination is first made as to whether the bus 19 has reached the end of the route, as indicated in a decisional flow chart block 81. If the bus 19 is at the end of its route, then the vehicle control process 76 stops, as indicated in a flow chart block 82, and does not start unless the start/reset switch 21 is triggered by the bus driver. Otherwise, the process 76 continues and makes a determination as to whether the bus 19 is late for the next stop, as indicated in a decisional flow chart block 83. In the preferred embodiment, the bus 19 is considered late if the bus 19 arrives at a stop more than 50 seconds after when it should have arrived. If the bus 19 is late, then a call is initiated to the base station control unit 14, as shown by a telephone bell symbol 84.

If the bus is not late, then the process 76 determines whether any of the switches 21, 22, 23 have been actuated, as indicated in a decisional flow chart block 86. If none of the switches 21, 22, 23 have been actuated, then the process 76 will loop back around and begin flow chart block 81 once again. Otherwise, if actuation of a switch is detected, the process 76 will determine which of the switches 21, 22, 23 has been actuated.

First, the process 76 will determine whether the move forward switch 22 has been actuated, as indicated in the decision flow chart block 87. If the bus driver has actuated the move forward switch 22, then the vehicle control unit 12 will retrieve the next stop number and corresponding stop time from a local data base having the route data 56. Moreover, a decision will be made as to whether the bus 19 is early for that particular stop, as indicated in the decision flow chart block 91. In the preferred embodiment, the bus 19 is considered early if the bus 19 arrives at a stop more than 50 seconds earlier than when it should have arrived. If the bus is not early, then the process 76 will loop back and proceed again with the flow chart block 81. Otherwise, a telephone call will be initiated to the base station control unit 14 to inform the unit 14 that the bus 19 is early, as illustrated by telephone call symbol 92.

In the event that the bus driver has not actuated the move forward switch 22, the process 76 proceeds to a decisional flow chart block 93 wherein the process 76 determines whether the move backward switch 23 has been actuated by the bus driver. If the move backward switch 23 has been actuated, then the process 76 obtains the previous stop number and stop time, displays these values on the display screen, and loops back to begin again with the flow chart block 81.

In the event that the bus driver has not actuated the move backward switch 23, then the process 76 determines whether the bus driver has actuated the start/reset switch 21, as indicated in the decisional flow chart block 96. If the start/reset switch 23 has not been actuated by the bus driver, then the process 76 loops back and begins again with the flow chart block 81. Otherwise, the process 76 loops back and begins again with the flow chart block 77.

C. Telephone Call Control Process

When a telephone call is initiated by the vehicle control unit 12 as indicated by the telephone call symbols 78, 84, 92, the vehicle control unit 12 follows a telephone call control process 101 as illustrated in FIG. 7. Initially, the telephone number corresponding with the base station control unit 14 is obtained from the EEPROM 43, as indicated in a flow chart block 102. Other information is also obtained, including among other things, the particular bus number, bus serial number, and bus route. Next, the control process 101 sets a time out variable to keep track of how many times a telephone connection has been initiated. The number n of allowable attempts is predetermined and is stored in the EEPROM 43.

After the time out variable has been implemented as indicated in the flow chart block 103, the control process 101 dials the telephone number on the mobile telephone 18, as indicated in the flow chart block 104. The control process 101 requires the vehicle control unit 12 to wait for a response from the base station control unit 14. If the vehicle control unit 12 does not receive a response within a predetermined time out period, preferably 20 seconds, the control process 101 loops back and begins again at the flow chart block 103. Otherwise, when the control process 101 determines that a response has been received, a validation procedure ensues, as indicated in a flow chart block 108. The validation process indicated at the flow chart block 108 is that which was described previously relative to the flow chart block 53 of FIG. 5. Essentially, it involves the exchange of symbols in order to assure a proper connection.

At the commencement of the validation process, another time out variable is set and will trigger termination of the telephone connection after a predetermined time period has run. The initiation of the time out variable and monitoring of the same is indicated in FIG. 7 at flow chart block 111. If the time out variable triggers termination of the telephone connection, then the control process 101 will hang up and end the call, as illustrated by a flow chart block 114. Otherwise, when the validation procedure has fully commenced, commands are passed from the base station control unit 14 to the vehicle control unit 12, as shown by a flow chart block 112. Commands which may be sent to the vehicle control unit 12 include, for example, the following: (1) Is the bus 19 either early or late?; (2) Reset the vehicle clock 24; (3) Record new information in the EEPROM 43. It should be emphasized that the base station control unit 14 may change the route information contained within the EEPROM 43 of the particular bus 19. The foregoing features enables extreme flexibility of the advance notification system 10.

Furthermore, the telephone call control process 101 determines whether the base station control unit 14 has finished its communication over the mobile telephone, as indicated in a flow chart block 113. Again, the control process 101 utilizes another time out variable to determine whether the base station control unit 14 has finished. After the predetermined time period of the time out variable, the control process 101 will assume that the base station control unit 14 has terminated its communication, and accordingly, the control process 101 will hang up the telephone, as indicated in a flow chart block 114. Otherwise, the control process 101 will loop back and begin with the flow chart block 111 in order to accept another command from the base station control unit 14.

Wherefore, the following is claimed:

1. An advance notification system for notifying passengers of an impending arrival of a vehicle at particular stop locations and corresponding scheduled times of arrival, comprising:

a plurality of passenger telephone means associated respectively with the passenger;

a vehicle control unit disposed on said vehicle, said vehicle control unit including vehicle control means, a vehicle communication means controlled by said vehicle control means, an input means for signaling to said vehicle control means when said vehicle reaches particular positions along said scheduled route, and a vehicle clock for tracking elapsed time of said vehicle while on said scheduled route, said vehicle control means having a wireless telephone means, said vehicle control means adapted to initiate a communication when said elapsed time of said vehicle at any of said particular positions is ahead of said scheduled time by greater than a first predetermined time period and when said elapsed time of said vehicle at any of said particular positions is behind said scheduled time by greater than a second predetermined time period, said vehicle control means for refraining from initiating said communication when said elapsed time of said vehicle at any of said particular positions is less than said first and second predetermined time periods; and a base station control unit having a base station communication means and a base station control means for controlling said base station communication means, said base station communication means having first and second telephone means, said first telephone means being a wireless communication device for communicating with said vehicle communication means, said second telephone means for communicating with said plurality of passenger telephones, said base station communication means for receiving said calls from said vehicle control unit and for receiving said amount of time in which said vehicle is ahead in time and behind in time, said base station control means for calling via said second telephone means each of said passengers to be boarded at a particular stop location via said base station communication means a third predetermined time period prior to said arrival of said vehicle at said particular stop location, the base station control unit causing a passenger telephone to ring only a preset number of times to indicate onset of said third predetermined time period.

2. The system of claim 1, wherein said input means comprises an odometer detector and wherein said particular positions correspond with mileage measurements from said odometer detector.

3. The system of claim 1, wherein said input means comprises a door detector and wherein said particular positions correspond with said particular stop locations.

4. The system of claim 1, wherein said input means comprises a means for communicating with the global positioning system (GPS) and wherein said particular positions are determined by data received from said GPS.

5. The system of claim 1, wherein said input means comprises a means for communicating with the LORAN positioning system and wherein said particular positions are determined by data received from said LORAN positioning system.

6. The system of claim 1, wherein said vehicle communication means and said base station communication means both comprise a wireless telephone for communication therebetween.

7. The system of claim 1, wherein said vehicle communication means and said base station communication means both comprise a wireless transceiver for communication therebetween.

8. A system for giving advance notice to a passenger of the impending arrival of a vehicle at a particular stop location as the vehicle travels along a scheduled route of stop locations, comprising:

(a) a passenger telephone situated with the passenger;

(b) a base station control unit having:

(1) a first base station telephone which provides wireless communications;

(2) a second base station telephone for communicating with said passenger telephone; and (3) a base station control means for contacting said passenger telephone with said second base station telephone an a predetermined time interval prior to arrival of said vehicle at said particular stop location; and (c) a vehicle control unit situated on said vehicle having:

(1) a vehicle telephone which provides wireless communications for communicating with said first base station telephone of said base station control unit;

(2) an input means for signaling when said vehicle has started along said scheduled route and when said vehicle is at said stop locations along said scheduled route;

(3) a vehicle clock for tracking elapsed time of said vehicle while said vehicle moves along said scheduled route; and (4) a vehicle control means for controlling said vehicle telephone and for monitoring signals from said input means and said vehicle clock, said vehicle control means for initiating a call to said base station control unit when said elapsed time of said vehicle while at a certain stop location is greater than a predetermined amount from a scheduled time, said vehicle control means for refraining from initiating a call to said base station control unit when said elapsed time of said vehicle while at said certain stop location is less than said predetermined amount from said scheduled time, the base station control unit causing a passenger telephone to ring only a preset number of times to indicate onset of said predetermined time interval.

9. The system of claim 8, (a) wherein said vehicle control unit comprises:

(1) a first means for initializing said vehicle clock and said elapsed time when said vehicle initiates movement along said scheduled route, said first means for initiating said call to said base station control unit when said vehicle resides at said certain stop location later than said scheduled time by greater than a first predetermined amount and for refraining from initiating said call when said vehicle resides at said certain stop location later than said scheduled time by less than said first predetermined amount, said first means for initiating said call to said base station control unit when said vehicle resides at said certain stop location earlier than said scheduled time by greater than a second predetermined amount and for refraining from initiating said call to said base station control unit when said vehicle resides at said certain stop location earlier than said scheduled time by less than said second predetermined amount; and (2) second means in communication with said first means, said second means for calling said base station control unit with said vehicle telephone by command of said first means, said second means for conveying said elapsed time and a next stop number to said base station control unit;

(b) wherein said base station control unit comprises:

(1) a third means for monitoring communications with said vehicle control unit, said third means for receiving said elapsed time and said next stop location, said third means for causing said vehicle control unit to reset said elapsed time to said scheduled time when said vehicle resides at said certain stop location earlier and later than said scheduled time based upon said elapsed time and said scheduled time; and (2) a fourth means in communication with said third means, said fourth means for identifying said passenger telephone based upon said next stop number, said fourth means for contacting said passenger telephone with said second base station telephone at a predetermined time interval prior to arrival of said vehicle at said particular stop location.

10. The system of claim 8, wherein said base station control unit comprises a means for causing said vehicle control unit to reset said elapsed time to said scheduled time when said base station control unit is called by said vehicle control unit.

11. The system of claim 8, wherein said vehicle control unit compares said elapsed time to a first predetermined amount from said scheduled time when said vehicle arrives at said certain stop location earlier than said scheduled time, and wherein said vehicle control unit compares said elapsed time to a second predetermined amount from said scheduled time when said vehicle arrives at said certain stop location later than said scheduled time.

12. The system of claim 8, wherein said passenger telephone is a wireless communications device.

13. The system of claim 8, wherein said input means comprises a detector on said vehicle for detecting operation of a door.

14. The system of claim 8, further comprising:

a manually-operated start switch, a manually-operated move forward switch, and a manually-operated move backward switch associated with said input means and accessible to a driver of said vehicle, said start switch being actuated by the driver when said vehicle initiates the scheduled route, said move forward switch being actuated by the driver after stopping at the particular stop location so that the elapsed time is reset said move backward switch being actuated by the driver to retreat said next stop number displayed on said display; and a display for illuminating a next stop number corresponding with a next stop location of the route.

15. The system of claim 8, wherein said input means comprises an odometer on said vehicle.

16. The system of claim 8, wherein said input means comprises a means for communicating with a position tracking system.

17. A method for giving advance notice to a passenger of the impending arrival of a vehicle at a particular stop location as the vehicle travels along a scheduled route of stop locations, comprising the steps of:

(a) providing the vehicle with a vehicle control unit having a wireless vehicle telephone;

(b) providing a base station with a base station control unit having first and second telephones, said first telephone being wireless for communicating with said wireless vehicle telephone for providing wireless communications between said vehicle control unit and said base station control unit;

(c) providing a passenger telephone with said passenger, said passenger telephone for communicating with said second telephone of said base station;

(d) minimizing communications between said base station and said vehicle by:

(1) monitoring elapsed time with said vehicle control unit as said vehicle moves along said scheduled route;

(2) comparing in said vehicle control unit the elapsed time to a scheduled time when said vehicle is at a certain stop location;

(3) when the elapsed time deviates from the scheduled time by greater than a predetermined limit, initiating a call from said vehicle control unit to said base station control unit to convey said elapsed time;

(4) when the elapsed time deviates from the scheduled time by less than said predetermined limit, refraining from initiating said call from said vehicle control unit to said base station control unit to convey said elapsed time; and (5) contacting the passenger at said passenger telephone with said base station control unit at a predetermined time interval before said vehicle is scheduled to arrive at a particular stop, the base station control unit causing a passenger telephone to ring only a preset number of times to indicate onset of said predetermined time interval.

18. The method of claim 17, further comprising the step of resetting said elapsed time to said scheduled time when the base station control unit is contacted by said vehicle control unit.

19. The method of claim 17, further comprising the steps of:

comparing said elapsed time to a first predetermined amount from said scheduled time when said vehicle arrives at said certain stop location earlier than said scheduled time; and comparing said elapsed time to a second predetermined amount from said scheduled time when said vehicle arrives at said certain stop location later than said scheduled time.

20. The method of claim 17, further comprising the step of using a wireless communications device for said passenger telephone.

21. The method of claim 17, further comprising the step of detecting when said vehicle is at said certain stop location by detecting operation of a door on said vehicle.

22. The method of claim 17, further comprising the step of detecting when said vehicle is at said certain stop location by detecting actuation of a switch on said vehicle.

23. The method of claim 17, further comprising the steps of:

providing a start switch, a move forward switch, and a display all connected to said vehicle control unit and accessible to a driver of said vehicle;

actuating said start switch when said vehicle initiates the scheduled route;

illuminating a next stop number corresponding with a next stop location; and actuating said move forward switch after stopping at the particular stop location so that the next stop number is advanced and displayed on said display and so that the elapsed time is reset.

24. The method of claim 23, further comprising the steps of:

providing a move backward switch connected to said vehicle control unit and accessible to a driver of said vehicle; and actuating said move backward switch to retreat said next stop number displayed on said display.

* * * * *